US011362459B2

(12) United States Patent
Johannes et al.

(10) Patent No.: US 11,362,459 B2
(45) Date of Patent: Jun. 14, 2022

(54) MOISTURE-SEALED CONNECTOR

(71) Applicant: SMITHS INTERCONNECT AMERICAS, INC., Kansas City, KS (US)

(72) Inventors: Richard A. Johannes, Trabuco Canyon, CA (US); Kenneth Stanevich, Tustin, CA (US)

(73) Assignee: SMITHS INTERCONNECT AMERICAS, INC., Kansas City, KS (US)

( * ) Notice: Subject to any disclaimer, the term of this patent is extended or adjusted under 35 U.S.C. 154(b) by 178 days.

(21) Appl. No.: 16/494,964

(22) PCT Filed: Mar. 26, 2018

(86) PCT No.: PCT/US2018/024376
§ 371 (c)(1),
(2) Date: Sep. 17, 2019

(87) PCT Pub. No.: WO2018/183205
PCT Pub. Date: Oct. 4, 2018

(65) Prior Publication Data

US 2020/0021058 A1 Jan. 16, 2020

Related U.S. Application Data

(60) Provisional application No. 62/477,943, filed on Mar. 28, 2017.

(51) Int. Cl.

| | |
|---|---|
| ***H01R 13/52*** | (2006.01) |
| ***H01R 13/6582*** | (2011.01) |
| ***H01R 43/00*** | (2006.01) |

(52) U.S. Cl.
CPC ..... *H01R 13/5221* (2013.01); *H01R 13/6582* (2013.01); *H01R 43/005* (2013.01)

(58) Field of Classification Search
CPC ..... H01R 13/5221; H01R 13/6582; H01R 43/005
See application file for complete search history.

(56) References Cited

U.S. PATENT DOCUMENTS

| | | | |
|---|---|---|---|
| 2006/0225913 | A1 | 10/2006 | Killian et al. |
| 2007/0066768 | A1 | 3/2007 | Gauthier et al. |

(Continued)

FOREIGN PATENT DOCUMENTS

| | | |
|---|---|---|
| CN | 201576923 | 9/2010 |
| CN | 105658302 | 6/2016 |
| EP | 0966066 | 12/1999 |

OTHER PUBLICATIONS

International Search Report and Written Opinion of the International Searching Authority (dated Jul. 17, 2018) for Corresponding International PCT Patent Application No. PCT/US18/02437646829, filed Mar. 26, 2018.

*Primary Examiner* — Abdullah A Riyami
*Assistant Examiner* — Nader J Alhawamdeh
(74) *Attorney, Agent, or Firm* — Snell & Wilmer LLP

(57) ABSTRACT

A method of forming a fluid resistant insulator for use in a connector includes collecting a part having a surface and electrically insulating properties. The method further includes applying a superhydrophobic sealant to the surface of the part having the electrically insulating properties. The method further includes curing the part with the superhydrophobic sealant applied to allow the superhydrophobic sealant to dry.

18 Claims, 4 Drawing Sheets

(56) References Cited

U.S. PATENT DOCUMENTS

| | | | | |
|---|---|---|---|---|
| 2009/0181567 | A1 | 7/2009 | Stockton et al. | |
| 2010/0264651 | A1* | 10/2010 | Flach | A61N 1/3752 285/351 |
| 2013/0344736 | A1* | 12/2013 | Latunski | H01R 13/521 439/587 |
| 2015/0004822 | A1* | 1/2015 | Liu | H01R 13/03 439/275 |
| 2015/0108682 | A1 | 4/2015 | Spear | |
| 2015/0322559 | A1* | 11/2015 | Killian | B05D 5/08 428/380 |
| 2016/0380380 | A1 | 12/2016 | Koepsell | |
| 2017/0028684 | A1 | 2/2017 | Imai et al. | |
| 2020/0021058 | A1* | 1/2020 | Johannes | H01R 13/5216 |

* cited by examiner

MOISTURE-SEALED CONNECTOR

CROSS REFERENCE TO RELATED APPLICATIONS

This application claims the benefit and priority of U.S. Provisional Patent Application No. 62/477,943, titled "Moisture-Sealed Connector" and filed on Mar. 28, 2017, the entire contents of which is herein incorporated by reference in its entirety.

BACKGROUND

Field

The present disclosure is directed to moisture sealed connectors and to methods of moisture proofing various parts of connectors.

Background of the Invention

Exposure of electrical connectors of various types to water and other liquids can result in moisture intruding into the connector. This moisture can be absorbed into the electrically insulating components or can ionize and distribute contaminants on a surface of the insulator. These insulating components can be fabricated from various materials, many of which may absorb moisture and many of which may receive distributed contaminants from ionized fluid. The absorbed moisture may undesirably reduce insulating properties of the insulators and, thus, may undesirably reduce the performance of the connector. Whereas some insulating materials are more resistant to this moisture intrusion, such materials may be undesirable for a specific design of a connector due to other properties of the material. Accordingly, an insulating material having less moisture resistance may be desirable for use in a connector. In some situations, these other properties (ones which may go hand in hand with relatively low moisture resistance) may be necessary to achieve certain functionality of the connector. The presence of moisture may degrade the insulation resistance of the connector system, undesirably resulting in increased leakage currents between a signal and ground or adjacent signal conductors. This may be of particular concern in capacitive filtered systems.

Connectors can be designed to reduce intrusion of a range of environmental penetrants including moisture. Such design, however, may add to the complexity of the connector, undesirably increasing the cost, which may not be acceptable to an end-user. Where a fully sealed design is not ideal for various reasons but reduction or elimination of the negative effects of intruding moisture is desirable, sealing the insulators may reduce or prevent deterioration of the their critical electrical properties.

Application of conventional sealants, such as epoxies, urethanes, silicones, or varnishes, introduces a layer of material that may abrade or chip off during connector handling and assembly. Furthermore, due to the application thickness of some of these sealants, the sealants may require more space than is available within the connector construction. In such a situation, inclusion of such sealants may require design changes to one or more aspect of the connector in order to create available space for the sealant. Due to the space requirements for these sealants, retrofitting existing connectors with the sealants may not be possible if sufficient space is not already present within the connector. Furthermore, conventional methods of sealing connectors (such as with conventional sealants, O-rings, or the like) may result in the connector having an increased cost and an increased size, both of which are undesirable.

As an alternate to these sealants, fluids (such as potting materials) can be flowed into the enclosed or interior areas of the connector. These fluids may create a relatively thick mechanical barrier to moisture intrusion. These fluids, which may include epoxies and urethanes, may solidify to some extent while in the enclosed or interior areas of the connector. These fluids may fill space where moisture may otherwise be capable of penetration. However, as with the sealants, acceptable coverage of insulators by these fluids may be unattainable unless sufficient space is available in the connector design to allow these fluids to flow to the desired areas and fully cover the insulating materials. Furthermore, these fluids may only be used to fill interior spaces or enclosed exterior spaces. Where an insulator is positioned on, or forms, an exterior surface, use of such fluids may be unavailable as they may flow off of the surface without providing moisture resistance. Furthermore, these fluids may cause contamination of contact surfaces, and if a ceramic capacitor of a connector is bonded in position, it may be damaged (such as by cracking) due to thermally induced differential expansion.

SUMMARY

The present disclosure is directed to a method of forming a fluid resistant insulator for use in a connector. The method includes collecting a part having a surface and electrically insulating properties. The method further includes applying a superhydrophobic sealant to the surface of the part having the electrically insulating properties. The method further includes curing the part with the superhydrophobic sealant applied to allow the superhydrophobic sealant to dry.

Also disclosed is a method for forming a fluid resistant component of a connector. The method includes collecting a part having a surface and designed to be used as at least one of an insulator or an electric shield in the connector. The method also includes applying a superhydrophobic sealant to the surface of the part. The method also includes curing the part with the superhydrophobic sealant applied to allow the superhydrophobic sealant to dry.

Also disclosed is a connector having a first portion including a conductive pin. The connector also includes a second portion having a conductive socket designed to receive the conductive pin to facilitate an electrical connection between the conductive pin and the conductive socket. The connector further includes a part designed for use in at least one of the first portion or the second portion as an insulator or an electrical shield and having a surface that has been cured with a superhydrophobic sealant to provide water resistant properties to the part.

BRIEF DESCRIPTION OF THE DRAWINGS

Other systems, methods, features, and advantages of the present invention will be or will become apparent to one of ordinary skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

A class of superhydrophobic sealants may have properties that are desirable for various parts of connectors. Conventional sealants or potting fluids may lack at least some of the desirable properties of the superhydrophobic sealants. These properties may include water resistance and being relatively thin after application, or entirely absorbed into the surface upon which they are applied.

This class of superhydrophobic sealants may be applied to electrical insulators, and in particular, insulators used in connectors having properties that make conventional sealants or potting fluid undesirable. A wide variety of insulating materials, including rigid, flexible, internal, external, and constructed of a wide range or material, may be coated by these superhydrophobic sealants. Such application of the syperhydrophobic sealants may render the insulating material impervious to moisture intrusion and moisture retention on the surface, or may significantly reduce moisture intrusion to an acceptable level. As an added benefit, the relative thinness of the superhydrophobic sealant may allow the solution to be retrofitted into existing designs where other methods of sealing are undesirable. For example, application of a superhydrophobic sealant on a surface of a part may increase a thickness of the part by 200 micrometers (8 thousandths of an inch) or less, or by 100 micrometers (4 thousandths of an inch) or less, or by 50 micrometers (2 thousandths of an inch) or less.

Figure 1:
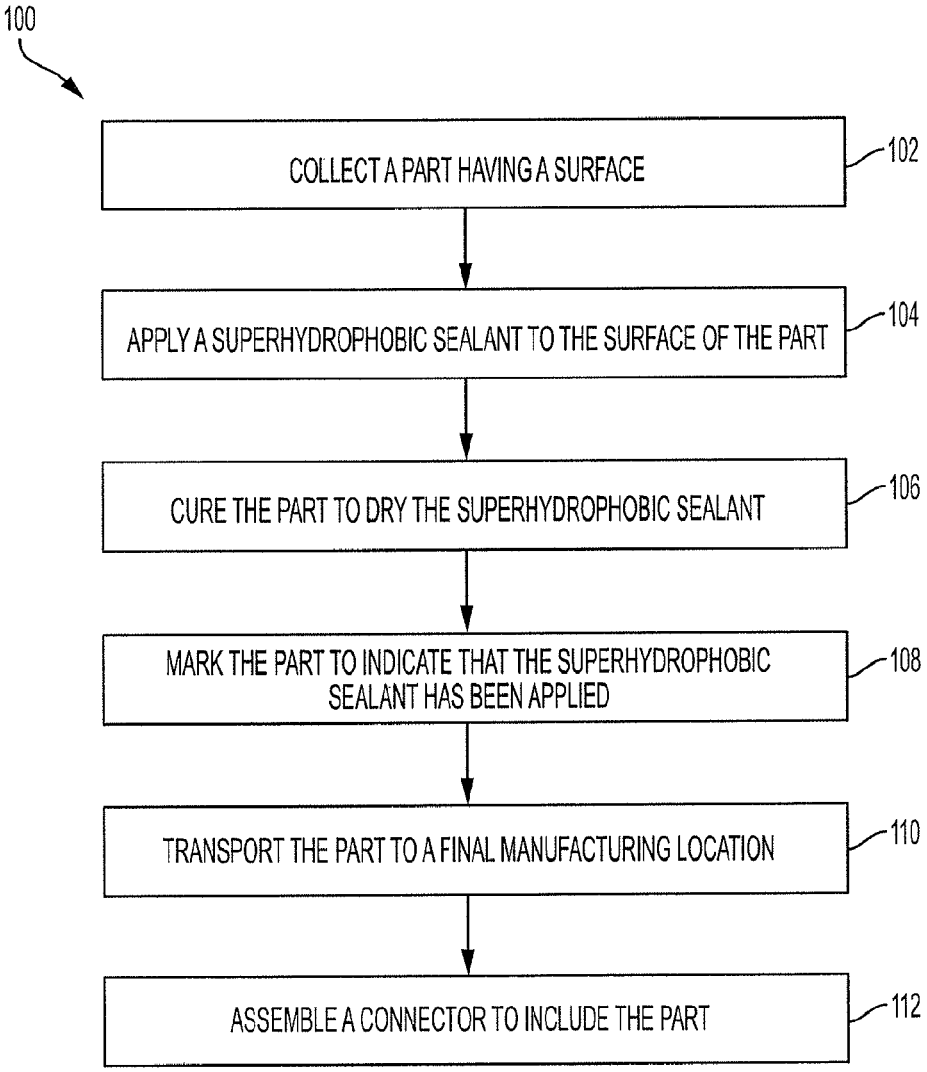
FIG. 1 is a flowchart illustrating a method for forming a water resistant connector according to an embodiment of the present disclosure.

Referring to FIG. 1, a method 100 for forming a fluid resistant part for use in a connector is shown. In block 102, a part may be collected. For example, the part may be purchased, formed, or otherwise obtained or created. The part may have electrically insulating properties and may thus be referred to as an insulator. In some embodiments, the part may instead have conductive properties, such as a metal, but may be intended for use as an electrical shield.

In block 102, a superhydrophobic sealant may be applied to the surface of the part. In some embodiments, the superhydrophobic sealant may be applied to an entire surface of the part. A superhydrophobic sealant may be defined as a material that can be applied to a surface that causes the surface to be extremely difficult to wet. For example, a superhydrophobic sealant may be a sealant that causes a contact angle of a water droplet on an applied surface to exceed 150 degrees.

Superhydrophobic sealants may include, for example, Polyurethane Silane or Tetraethoxysilane (such as a material available under the tradename Gentoo™ from Ultratech International of Jacksonville, Fla.), a Silicone derived polymer (such as a material available under the tradename NeverWet™ from NeverWet LLC of Lancaster, Pa.), Polyurethane Silane (such as a material available under the tradename Nanoproof® from Aculon of San Diego, Calif.), or the like. These sealants may have desirable electronic properties (i.e., may be non-conductive), may be relatively thin when applied, and may provide sufficient moisture resistance in relatively thin applications. These sealants may further resist cracking or other damage to the layer of sealant and the part to which it is applied. These superhydrophobic sealants may be referred to as a nanoscopic surface layer that repels water. These sealants may be absorbed by a surface and/or may insignificantly alter a thickness of the surface to which it is applied.

Application of these sealants generally includes steps to assure wetting and/or absorption of the sealant into the applied surface. For example, the components may be dipped into a volume of sealant, the sealant may be sprayed on the component, or the sealant may be otherwise placed on the component (such as by brushing on the sealant).

In some embodiments, the superhydrophobic sealants may be applied to insulators prior to assembly of the connector. Since the treated insulators and components (i.e., parts) can be packaged and stored in much the same manner as the untreated insulators, subject parts can be bulk-treated with the sealant immediately after fabrication, regardless of whether they are initially molded, extruded, or machined, and prior to packaging and delivery to the connector assembly site.

In block 106, the part may be cured in order to dry the superhydrophobic sealant. For example, the part (with the sealant in place) may be subjected to a dwell time where heat may be used to accelerate the drying and curing of the sealant. In some embodiments, the part may be cured at room temperature after application of the superhydrophobic sealant without additional heat application.

In block 108, the part may be marked to indicate that the superhydrophobic material has been applied. For example, a label or other marking may be placed on the part to indicate that the component has been subjected to the sealing process (i.e., that the superhydrophobic sealant has been applied to the part). In some embodiments, a colorant may be added to the superhydrophobic sealant. In that regard, a part having a color that matches that of the colorant may be identified as a part that has been treated with the superhydrophobic sealant.

In block 110, the part may be transported to a final manufacturing location. Once dried and cured, the insulators may be packaged for shipment to the assembly site in a similar manner as for non-treated insulators. This is due to the relative thinness and durability of the superhydrophobic sealant, which provides an advantage over conventional sealants which may chip or otherwise degrade during packing and transport.

In block 112, the connector may be assembled with the sealed part included. As described above, the sealed part may be an insulator, may provide electrically insulating properties, or may provide electrical shielding properties.

The superhydrophobic properties of the sealant may provide several benefits and advantages for the assembled connector. For example, a sealed insulator may prevent moisture ingress into a housing, or into a cavity at least partially defined by the sealed part, thus protecting and extending a life of a component (such as a metal terminal) housed within the cavity. Additionally, dirt, contaminant, and other debris accumulation on the part may be reduced as any moisture that would normally cause the debris to collect on the part may be incapable of remaining on the surface of the part. The superhydrophobic properties may extend the life of an insulator by preventing moisture ingress into the material of the insulator itself.

The superhydrophobic properties of the sealant may provide additional benefits for metal parts. For example, a metal part treated with a superhydrophobic sealant may be rust proof or rust resistant as moisture may be incapable of collecting on the surface of the metal part.

The method 100 may be used for parts of various unsealed connector products in which moisture protection and the prevention of accumulation of standing moisture is desirable.

Superhydrophobic sealants may be used to reduce moisture intrusion on a variety of devices. Due to the property of the sealant (increasing the surface energy at the applied surface, and therefore reducing the surface tension of subsequently spilled liquids on said surface), water and other liquids may bead up and roll off of the treated surface. Direct application of these superhydrophobic sealants to components of a connector may limit electrical degradation of the components of connector systems by preventing moisture and liquid ingress into a cavity and/or an interface. By limiting the ingress and retention of moisture and liquids, the loss of insulation resistance performance is significantly reduced, while cost and packaging size is decreased by eliminating the need for a more expensive elastomeric seal or another conventional relatively expensive approach.

Figure 2:
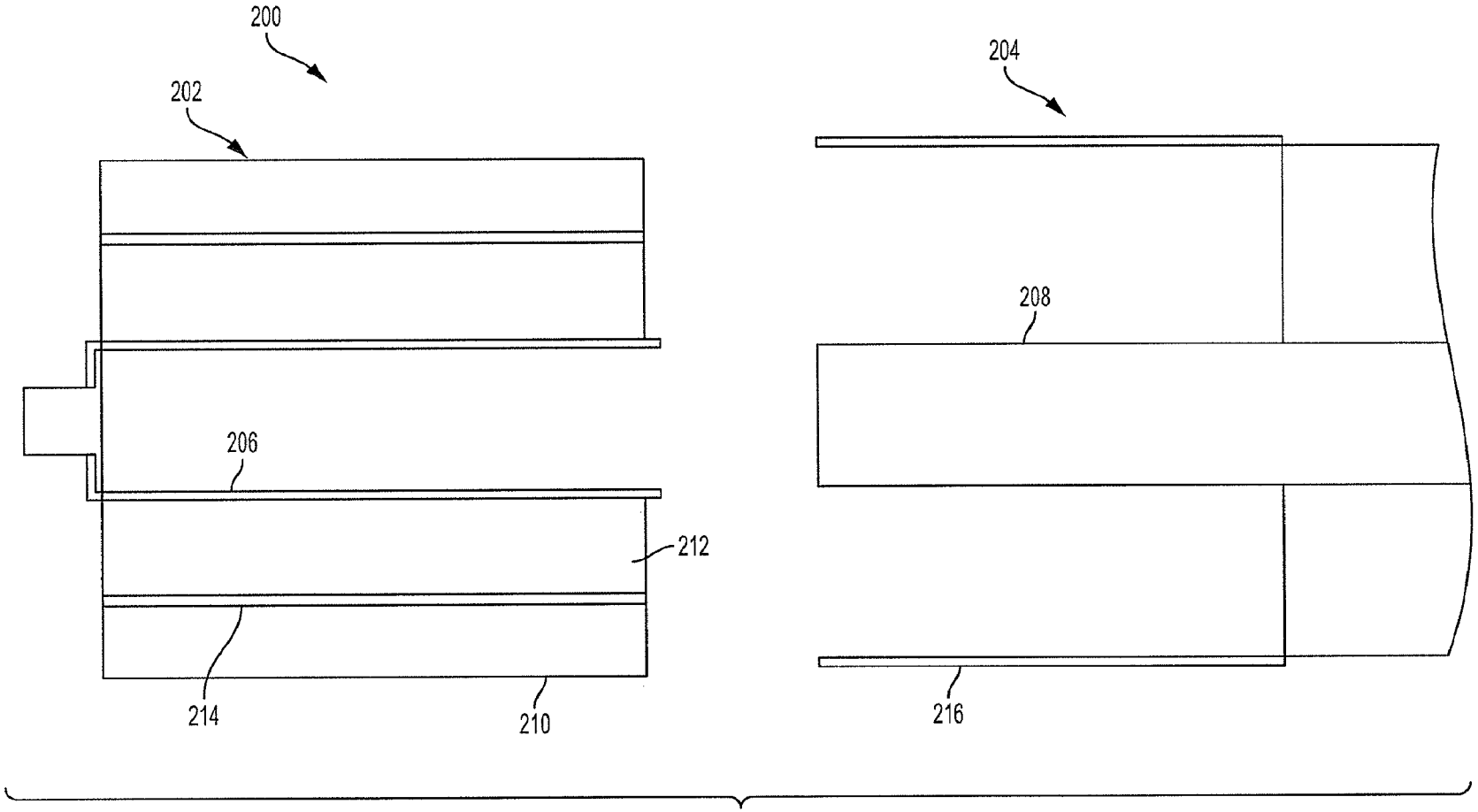
FIG. 2 is a drawing illustrating a connector having various water resistant parts according to an embodiment of the present disclosure.

Referring now to FIG. 2, a moisture-sealed connector 200 is shown. The connector 200 includes a female portion 202 and a male portion 204. The female portion 202 includes a conductive socket 206, and the male portion 204 includes a conductive pin 208. The socket 206 is designed to receive the pin 208 in order to facilitate an electrical connection therebetween.

The female portion 202 further includes a housing 210 which may include an insulating material such as nylon, rubber, plastic, or the like. The female portion 202 also includes an insulator 212 which may also include an insulating material such as nylon, rubber, plastic, or the like. An electrical shield 214 may be located radially between the insulator 212 and the housing 210. The electrical shield 214 may include a metal and may have properties that shield the socket 206 from wireless signal interference from an environment of the connector 200. Stated differently, the electrical shield 214 may resist electrical interference with the connection between the socket 206 and the pin 208.

The male portion 204 further includes a housing 216. The housing 216 may include an insulating material or a conductive material.

Figure 3:
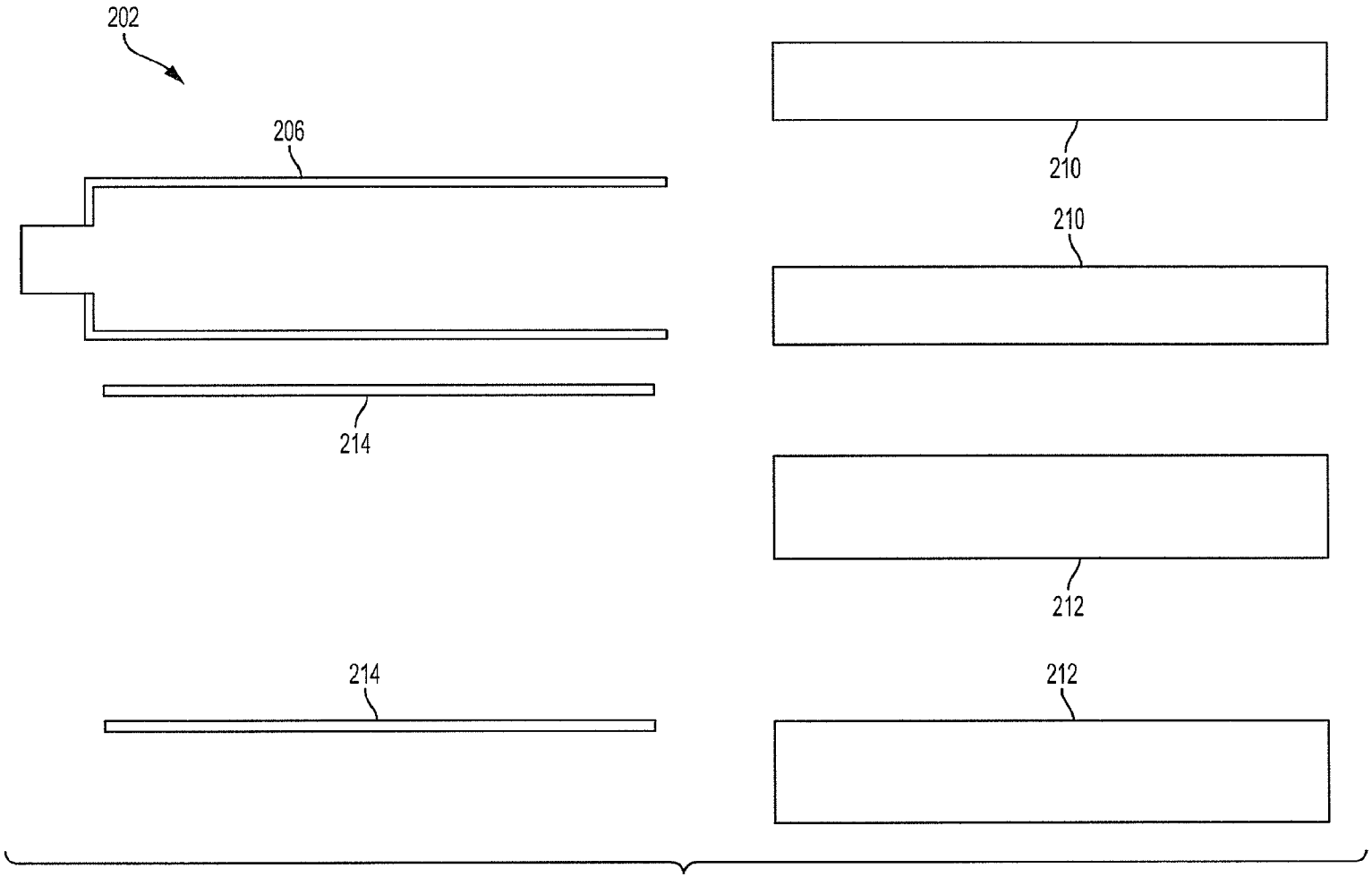
FIG. 3 is a drawing illustrating various parts of a female portion of the connector of FIG. 2 according to an embodiment of the present disclosure.

Various parts of the connector 200 may have one or more surface that has been cured with a superhydrophobic sealant to provide water resistant properties to the connector 200. For example and referring to FIG. 3, cross-sectional views of the parts of the female portion 202 are shown. Because superhydrophobic sealant may have insulating properties, it may be undesirable to apply the superhydrophobic sealant to the socket 206. However, each of the electrical shield 214, the housing 210, and the insulator 212 may be treated with a superhydrophobic sealant prior to assembly of the female portion 202. For example, each of the electrical shield 214, the housing 210, and the insulator 212 may be dipped in a bath of superhydrophobic sealant in order to coat all surfaces of these parts with the superhydrophobic sealant. After coating the surfaces of these parts with the superhydrophobic sealant, each of the electrical shield 214, the housing 210, and the insulator 212 may be cured by applying heat or by allowing them to dry at room temperature.

After the superhydrophobic sealant has been cured, each of the electrical shield 214, the housing 210, and the insulator 212 may be marked or otherwise identified as parts that have been treated with the superhydrophobic sealant. The electrical shield 214, the housing 210, the insulator 212, and the socket 206 may be transported to a final manufacturing location and assembled into the final female portion 202 of the connector 200 shown in FIG. 2.

Returning reference to FIG. 2, the housing 216 of the male portion may also be treated with the superhydrophobic sealant, regardless of whether the housing 216 is metal or an insulator.

The superhydrophobic sealant may prevent ingress of moisture into the female portion 202 of the connector 200. In particular, the superhydrophobic sealant on the surface of the insulator 212 may significantly reduce the likelihood of moisture being received between the socket 206 and the insulator 212, as well as between the insulator 212 and the electrical shield 214. Likewise, the superhydrophobic sealant on the surface of the electrical shield 214 may significantly reduce the likelihood of moisture being received between the insulator 212 and the electrical shield 214, and likewise between the electrical shield 214 and the housing 210. Additionally, the superhydrophobic sealant on the surface of the housing 210 may significantly reduce the likelihood of moisture being received between the housing 210 and the electrical shield 214. The superhydrophobic sealant on the surface of the housing 210 may further reduce the likelihood of moisture resting on an outer surface of the housing 210, thus reducing the likelihood of moisture damage to the outer surface of the housing 210.

Figure 4:
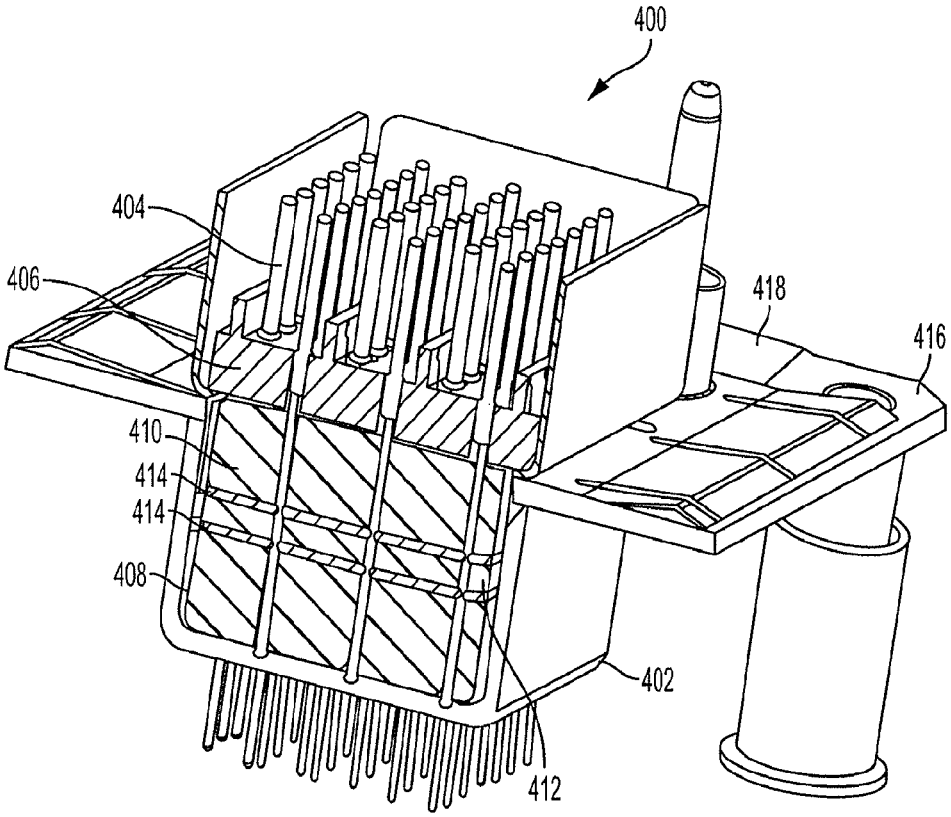
FIG. 4 is a drawing illustrating a moisture sealed male connector according to an embodiment of the present disclosure.
Figure 5:
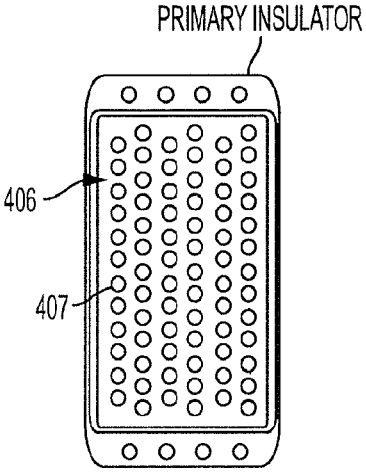
FIG. 5 is a drawing illustrating a moisture resistant insulator of the moisture sealed male connector of FIG. 4 according to an embodiment of the present disclosure.

Referring now to FIG. 4, a male connector 400 is shown. The male connector 400 includes a housing 402, a plurality of pins 404, and an insulator 406. With brief reference to FIGS. 4 and 5, the insulator 406 defines a plurality of openings 407, each of the openings 407 designed to receive a corresponding pin of the plurality of pins 404.

Returning reference to FIG. 4, the housing 402 defines a cavity 408. The insulator 406 may be positioned within the cavity 408. The male connector 400 may further include a plurality of ferrite blocks 410 surrounding a ceramic capacitor array 412, both located within the cavity 408. One or more rubber mat 414 may be located between the ferrite blocks 410 the ceramic capacitor array 412. The male connector 400 may further include an attachment flange 416 to facilitate connection to a female connector (not shown). The male connector 400 may further include a ground plane 418 that extends along a portion of the attachment flange 416 and into the cavity 408 to contact the ceramic capacitor array 412.

Various elements of the male connector 400 may be coated with a superhydrophobic sealant. For example, the housing 402, the insulator 406, the ferrite blocks 410, and the rubber mats 414 may be treated with a superhydrophobic sealant prior to assembly of the male connector 400. After each of these parts has been treated with the superhydrophobic sealant (i.e., after the superhydrophobic sealant has been applied and the parts have been cured) the male connector 400 may be assembled as shown in FIG. 4.

The coating of the housing 402, the insulator 406, the ferrite blocks 410, and the rubber mats 414 may extend the life of the male connector 400. In particular, the superhydrophobic sealant may provide waterproofing or water resistant properties to these parts. For example, the superhydrophobic properties of the insulator 406 and the housing 402 may prevent or reduce the likelihood of moisture ingress into the cavity 408 (such as between the housing 402 and the insulator 406, and between the insulator 406 and the pins 404). Additionally, the superhydrophobic properties of the ferrite blocks 410 and the rubber mats 414 may further prevent or reduce the likelihood of moisture reaching the ceramic capacitor array 412, or collecting on these parts and thus damaging them.

Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A method of forming a fluid resistant insulator for use in a connector, the method comprising:

collecting a part including a housing defining a cavity, the cavity containing a plurality of ferrite blocks and at least one rubber mat located between the plurality of ferrite blocks;

applying a superhydrophobic sealant to at least one of the housing, the plurality of ferrite blocks, and the at least one rubber mat; and curing the at least one of the housing, the plurality of ferrite blocks, and the at least one rubber mat to allow the superhydrophobic sealant to dry.

2. The method of claim 1 wherein curing the at least one of the housing, the plurality of ferrite blocks, and the at least one rubber mat includes heating the at least one of the housing, the plurality of ferrite blocks, and the at least one rubber mat to accelerate the curing.

3. The method of claim 1 wherein collecting the part includes removing the part from the connector in order to retrofit the connector to have fluid resistance.

4. The method of claim 1 wherein collecting the part includes receiving the part after the part has been manufactured and before the connector has been assembled.

5. The method of claim 1 further comprising transporting the at least one of the housing, the plurality of ferrite blocks, and the at least one rubber mat to a final manufacturing location for manufacture of the connector in a similar manner as an untreated part would be transported.

6. The method of claim 1 further comprising applying a colorant to the superhydrophobic sealant to indicate that the at least one of the housing, the plurality of ferrite blocks, and the at least one rubber mat has been treated with the superhydrophobic sealant.

7. The method of claim 1 further comprising marking or labeling the at least one of the housing, the plurality of ferrite blocks, and the at least one rubber mat to indicate that the part has been treated with the superhydrophobic sealant.

8. The method of claim 1 wherein applying the superhydrophobic sealant to the at least one of the housing, the plurality of ferrite blocks, and the at least one rubber mat includes at least one of dipping the at least one of the housing, the plurality of ferrite blocks, and the at least one rubber mat into a volume of the superhydrophobic sealant or spraying the superhydrophobic sealant onto the at least one of the housing, the plurality of ferrite blocks, and the at least one rubber mat.

9. A method for forming a fluid resistant component of a connector, comprising:

collecting a part having a surface and configured to be used as a rubber mat in the connector;

applying a superhydrophobic sealant to the surface of the part; and curing the part with the superhydrophobic sealant applied to allow the superhydrophobic sealant to dry.

10. The method of claim 9 wherein curing the part with the superhydrophobic sealant includes applying heat to the part with the superhydrophobic sealant to accelerate the curing.

11. The method of claim 9 wherein collecting the part includes removing the part from the connector in order to retrofit the connector to have fluid resistance.

12. The method of claim 9 further comprising transporting the part with the superhydrophobic sealant to a final manufacturing location for manufacture of the connector in a similar manner as an untreated part would be transported.

13. The method of claim 9 further comprising applying a colorant to the superhydrophobic sealant to indicate that the part has been treated with the superhydrophobic sealant.

14. The method of claim 9 further comprising marking or labeling the part with the superhydrophobic sealant to indicate that the part has been treated with the superhydrophobic sealant.

15. The method of claim 9 wherein applying the superhydrophobic sealant to the part includes at least one of dipping the part into a volume of the superhydrophobic sealant or spraying the superhydrophobic sealant onto the surface of the part.

16. A connector having:

a first portion including a conductive pin;

a second portion having a conductive socket configured to receive the conductive pin to facilitate an electrical connection between the conductive pin and the conductive socket; and a part configured for use in the first portion as a rubber mat and having a surface that has been cured with a superhydrophobic sealant to provide water resistant properties to the part.

17. The connector of claim 16 wherein the surface that has been cured with the superhydrophobic sealant is an entire surface of the part.

18. The connector of claim 16 wherein the superhydrophobic sealant has a thickness that is less than or equal to 100 micrometers (0.04 thousandths of an inch).

* * * * *